US008015673B2

(12) United States Patent
Rodman

(10) Patent No.: US 8,015,673 B2
(45) Date of Patent: Sep. 13, 2011

(54) BOLO STYLE CLASP WITH MULTI-PURPOSE CLIP

(75) Inventor: Harry Rodman, Riverdale, NY (US)

(73) Assignee: Dean Gould, Hermosa Beach, CA (US)

( * ) Notice: Subject to any disclaimer, the term of this patent is extended or adjusted under 35 U.S.C. 154(b) by 873 days.

(21) Appl. No.: 12/009,654

(22) Filed: Jan. 22, 2008

(65) Prior Publication Data

US 2009/0183345 A1 Jul. 23, 2009

(51) Int. Cl.
*A41D 25/04* (2006.01)

(52) U.S. Cl. ..... 24/66.9; 24/115 H; 24/3.4; 24/331; 2/150

(58) Field of Classification Search ..... 2/66.9, 2/66.4, 66.8, 66.6, 115 H, 331, 338, 144, 2/145, 153, 150; 24/712.1, 712.2, 712.5, 24/712.6; 63/19
See application file for complete search history.

(56) References Cited

U.S. PATENT DOCUMENTS

| | | | | | |
|---|---|---|---|---|---|
| 670,561 | A | * | 3/1901 | Hoegemann | 24/712.6 |
| 1,143,580 | A | * | 6/1915 | Fuller | 24/66.8 |
| 1,616,694 | A | * | 2/1927 | Hoppe | 24/712.6 |
| 2,129,491 | A | | 9/1938 | Chilson | |
| 2,450,620 | A | | 10/1948 | Speicher | |
| 2,545,267 | A | | 3/1951 | Donle | |
| 2,896,217 | A | | 7/1956 | Cedarstaff | |
| 2,766,500 | A | | 10/1956 | Chenko | |
| 3,187,396 | A | | 6/1965 | Carroll | |
| 3,204,306 | A | * | 9/1965 | Anderson | 24/52 |
| 3,364,500 | A | | 1/1968 | Fox | |
| 3,675,277 | A | | 7/1972 | Day | |
| 3,813,737 | A | | 6/1974 | Larsen | |
| 3,958,277 | A | * | 5/1976 | Girdler | 2/153 |
| 4,035,873 | A | | 7/1977 | Epperson | |
| 4,106,123 | A | | 8/1978 | Freedman | |
| 4,159,542 | A | * | 7/1979 | Pehr | 24/66.4 |
| D255,729 | S | | 7/1980 | Harriman | |
| 4,912,814 | A | | 4/1990 | McKenzie | |
| 5,008,981 | A | | 4/1991 | Smithson | |
| 5,379,928 | A | | 1/1995 | Mikkelsen | |
| D358,019 | S | | 5/1995 | Lakin | |
| D358,116 | S | | 5/1995 | Huges | |
| 5,493,731 | A | * | 2/1996 | Amnott | 2/153 |
| 5,664,287 | A | | 9/1997 | Manduklan | |
| 5,765,227 | A | | 6/1998 | Wright | |
| D405,937 | S | | 2/1999 | Wrobel | |
| 6,070,303 | A | | 6/2000 | Macy et al. | |
| 6,381,985 | B1 | | 5/2002 | Burgard | |
| D538,196 | S | | 3/2007 | Lee | |

* cited by examiner

*Primary Examiner* — Robert Sandy
(74) *Attorney, Agent, or Firm* — Kevin M. Welch, Esq.

(57) ABSTRACT

A bolo style clasp or slide is modified and improved by affixing an engagement apparatus to its posterior surface. The engagement apparatus can vary in both size and specie so as to best accommodate the intended coupling item. The addition of the engagement apparatus expands the versatility of the bolo style clasp or slide by allowing it to serve its original ornamental function and any one of several utilities. Further, the anterior surface of the bolo style clasp or slide is hinged so as to allow the surface to rotate exposing an interior area. The interior area can be used for the storage of small items or situating an exchangeable ornamental face.

5 Claims, 3 Drawing Sheets

BOLO STYLE CLASP WITH MULTI-PURPOSE CLIP

CROSS-REFERENCE TO RELATED APPLICATIONS

Not Applicable

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to wearable accessories and more particularly to an improved variety of a bolo style tie clasp or slide incorporating the addition of a multi-purpose coupling apparatus.

2. Description of Related Art Including Information Disclosed Under 37 CFR 1.97 and 1.98

Macy et. al., U.S. Pat. No. 6,070,303, discloses a pendant-like device which hangs around the neck and holds sunglasses in a forward facing position at mid-chest level. All models consist of a pendant that is suspended at mid chest level by a cord which loops behind the neck of the user. The holding mechanism is one of several disclosed designs whereby the middle portion of the sunglasses is inserted into an upwardly oriented notch. The Epperson reference, U.S. Pat. No. 4,035,873, describes a clip for bola tie together with a fixed cooperative means attached to the rear surface of the ornamental mount thereof providing a quick and easy conversion from a bola tie to a chain-and-pendant arrangement with the common use of the ornamental portion of the bola tie. The Mikkelsen reference, U.S. Pat. No. 5,379,928, discloses an adjustable breakaway neck noose for retaining one end of a cylindrical container. The reference includes a flexible cord of a predetermined length having an exterior surface of a woven material and a first and second end which a noose can be formed from therebetween. A holder is further incorporated for coupling with the end of a cylindrical container. The holder has a top surface featuring a raised tab and a hole traversely defined throughout of sufficient size to receive the first and second ends of the cord, yet frictionally engage the exterior surface of the cord. The holder may be positioned along a locus of points along the length of the cord so as to change the size of the noose. A bottom surface of the holder defines a cup with an interior circular wall sized to receive and frictionally engage the end of the cylindrical container. A clip is incorporated for affixing the first and second ends of the cord together and frictionally holding the first and second ends of the cord when a predetermined amount of tension above one pound is exerted between the clip and the cord. The Chanko reference, U.S. Pat. No. 2,766,500, describes a suspending apparatus in the form of a strap or similar flexible suspension member which is adapted for wear around a person's neck and carries at its ends readily attachable and detachable clamps, adapted to couple with a pair of spectacles. Further, the clamps have improved provisions for quick and facile attachment and removal. The McKenzie reference, U.S. Pat. No. 4,912,814, discloses a bolo clasp for a bolo tie of the type which includes a braided cord extending around the neck of the wearer, the cord having two ends, the cord being received by the bolo clasp so that the two ends extend below the bolo clasp and the clasp allows adjustments of the length of the cord extending below the clasp, the clasp having a base with a short base post extending upwardly therefrom. The base defends a pair of recesses that open toward the base. A clamping member is disposed between the base of each of the recesses. A short clamping member port is affixed The Larsen reference, U.S. Pat. No. 3,813,737, discloses a clasp which includes provisions for interchanging a plurality of mounts for use with a bola tie and also provisions for maintaining the braids of a bola tie in a fixed position with respect to the clasp and mount. Further, disclosed are means for quickly releasing both the braids and the mount for either removing the bola tie from the neck of the wearer or for replacing or interchanging mounts. The Day reference, U.S. Pat. No. 3,675,277, discloses a bolo clasp including a base, a means carried by the base defining a pair of recesses that open toward the base, a clamping member disposed between the base and each recess, and means of yieldably urging the clamping member away from the base and toward the recesses, said yieldable means includes a coil compression spring disposed between the base and clamping member. The Carroll reference, U.S. Pat. No. 3,187,396, discloses a resilient metal member for frictioning a lariat strand composed of two sections each having a wall from which a side wall extends and telescopes one another forming a top and bottom wall. The two members contain intergaging parts allowing the apparatus to assemble about the lariat. A friction member formed of sheet stock folded on itself engages the lariat strand. The Cedarstaff reference, U.S. Pat. No. 2,896,217, discloses a bolo tie clasp or slide that includes a side apparatus that can receive a braided cord easily and protrusions located such that once the braided cord is received it can be adjusted to allow the protrusions to create a friction contact with the braided cord thereby preventing the braided cord from slipping. The Mandukian reference, U.S. Pat. No. 5,664,297 describes a bolo tie device or the like for displaying ornamentation and/or identification thereon. The disclosed bolo tie-type device has a cord member of sufficient length to pass behind the wearers's neck and provides two depending ends therefrom and a display/securing member having a front surface and a back surface, the front surface being suitable to support decorative or identifying indicia thereupon, the back surface having securing means defined thereon for holding the display/securing member in a preselected position relative to the depending ends of the cord member and preventing involuntary movement thereof regardless of the wearer's activity. The securing means includes a plurality of strategically disposed post members therethrough in secure non-slipping relationship therewith. Preferably, the disclosed apparatus has two sets of members which include a first and a second cylindrical post member substantially vertically aligned with each other in a spaced relationship therebetween. Each set may further include respective third post members or there may be a singular third post shared between the two sets. The third post members are disposed intermediate of each the first and second cylindrical post member and offset from the vertical alignment thereof and having a notch defined therein on the lower interior side thereof The Smithson reference, U.S. Pat. No. 5,008,981, discloses a clasp for cords of a bola tie that includes two mating shell halves and a manually operable spring biased clasp disposed between the shell halves to provide an enclosed clasp which is releasable and which provides improved external appearance and mechanical function. The inner surfaces of the clasp which engage the tie ends are smooth non-abraiding convex portions of toroidal-like surfaces and clasp the tie ends around an extensive part of the periphery of the cord and along extended portions of the cord. Although firmly clasping the cord ends the clasp may be forced along the cord ends without manually releasing the clamp. The Wright reference, U.S. Pat. No. 5,765,227 describes a new bolo tie and method of fabrication for constructing a novel appearance of a bolo clasp. The disclosed device includes a bolo clasp having a predetermined shape. The bolo clasp has a front portion and a rear portion. The front portion has an arcuate outer surface and a planar inner surface. The rear portion extends outwardly from the planar inner surface. The rear portion has a pair of apertures therethrough. The arcuate outer surface of the front portion has a recess formed therein. A layer of epoxy is disposed within the recess formed therein. A decorative stone is secured within the recess by the layer of epoxy. A length of cord has opposed free ends received through the pair of apertures of the bolo clasp. A pair of agelets are secured to the free ends of the length of cord. The Freedman reference, U.S. Pat. No. 4,106,123, discloses an article of jewelry to be worn encircling a portion of the body, such as a neck piece or belt. The article is formed from a length of flexible material, two portions of which are engaged by a plurality of hoops disposed on a slide. The hoops are positioned so as to receive the portions of flexible material in frictional engagement of each other, permitting adjustment of the length of flexible material between the two portion so engaged. The Burgard reference, U.S. Pat. No. 6,381,985, discloses a jewelry apparatus adapted to serve as practically any type of jewelry, but is best suited for use as a pendant or broach. A shaft portion is removably attached to a base piece by means of a slotted locking member. The shaft piece is used to carry ornamental elements, such as decorative beads or precious or semiprecious stones. The ornamental elements may be permanently affixed to the shaft, or most desirably may be slipped onto the shaft so as to be interchangeable. Accordingly, the disclosed device permits a user to change the ornamental elements by removing the shaft from and selectively interchanging the base piece. Alternatively, the entire shaft with ornamental elements thereon may be selectively replaced. In either case, the disclosed device allows the user to change the overall appearance of the jewelry apparatus and customize it to occasion or apparel, two security features are disclosed with the purpose assuring that the shaft cannot accidentally be removed from the base piece resulting in the loss of the ornamental elements. The Speicher reference, U.S. Pat. No. 2,450,620, discloses a locket style apparatus constructed from contoured component parts made of transparent material having circular cavities formed in the inner medial portions thereof. The reference further discloses a conical socket formed in one of the said cavities with a jewel having the conical portion thereof seated in the socket and the bottom of the second cavity contacting the face of the jewel thereby retaining the jewel in the socket and a means for fastening the parts together as a unit. The Chilson reference, U.S. Pat. No. 2,129,491 describes a locket style device with a pair of members hinged together, each provided with peripheral lips. A frame in each member having an opening for exposing a picture, said lips being rolled over each frame to mount it in position without the use of solder. The reference further discloses each of said frames being recessed, and an intermediate member hinged between said members and of a size to be partially received in each recess when the members are closed. The Donele reference, U.S. Pat. No. 2,545,267, discloses a locket construction including, a base, a cover hinged thereto, a hinged roll on the base, a catch member of the cover adapted to be positioned adjacent the hinged roll when the cover is in closed relation to the base, the catch member having a transverse catch rib and a manually moveable latch member having an upper loop. The reference further discloses two spaced lower arms at substantially right angles to the loop with theirs ends inturned and seated in the hinge roll. Additionally, the Donele reference discloses a transverse bar positioned to swing over the catch member rib when the latch member is turned to engage the catch member. The Fox, U.S. Pat. No. 3,364,500, describes a bolo tie structure including a pair of substantially flat opposed plate members that are substantially contiguous. Each containing recessed portions to communicate frictionally with a braided leather flexible tie member. The Harriman reference, U.S. Pat. No. Des. 255,729 discloses an ornamental design for a bola tie. Likewise the Wrobel reference, U.S. Pat. No. Des. 405,937, also discloses an ornamental design for a bola tie kit. The Lee reference, U.S. Pat. No. D538196 discloses an ornamental design for a photograph display locket. The Huges reference, U.S. Pat. No. Des. 358,166, discloses an ornamental design for a combined neckwear clasp and picture display. The Lakin reference, U.S. Pat. No. Des. 358,019, discloses the ornamental design for a boot bolo. And finally the Huges reference, U.S. Des. 358,116, discloses a particular ornamental design for a combined neckwear clasp and picture display.

The related art described above discloses a plurality bola or bolo ties, bola clasp or slide mechanisms, tethering apparatuses, locket mechanisms, and a variety of convertible jewelry. Also disclosed are a variety of ornamental designs of the same. The novelty of the bola tie, clasp and slide disclosures lie in the unique method in which each clasp or slide both accepts and frictionally communicates with the cord, braid or lariat portion of the bolo tie. Likewise novelty of the locket references lie in the particular component parts and the relation in which they are disposed. Further, the tethering apparatus references disclose a plurality unique component elements specialized for a narrow variety of coupling methods.

The prior art fails to disclose a bolo style clasp or slide combined with the additional and unique element of a posteriorly located multipurpose coupling device. Additionally, the related art does not teach the advantage of further incorporating a locket style hinged ornamental face onto the anterior surface. The present disclosure distinguishes over the prior art providing heretofore unknown advantages as described in the following summary.

BRIEF SUMMARY OF THE INVENTION

This disclosure teaches certain benefits in construction and use which give rise to the objectives described below. This disclosure concerns a bolo style clasp or slide with a decorative face affixed to the anterior surface and a mechanism for frictionally engaging a cord, braid or lariat on the posterior surface. Additionally, affixed to the posterior surface is a multipurpose coupling apparatus. Said coupling apparatus can vary in both size and specie so as accommodate a variety of coupling items. In one embodiment, the engagement apparatus would include a pivotable member attached at its fulcrum about which a coil spring is wound. Further, in another embodiment the decorative or ornamental face is hinged so as to allow the surface to rotate exposing an interior cavity.

A primary objective inherent in the above described apparatus and method of use is to provide advantages not taught by the prior art.

Another objective is to provide such an invention capable of serving as both a decorative accessory and a functional utility.

A further objective is to provide a wearable accessory capable of reversibly coupling with a plurality of small items.

A still further objective is to provide a bolo style clasp or slide capable of attaching to a napkin and holding it in an appropriate position to provide drip and spill protection for the wearer's clothing.

A yet still further objective is to provide a bolo style clasp or slide capable of storing small items within an interior cavity.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiments, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
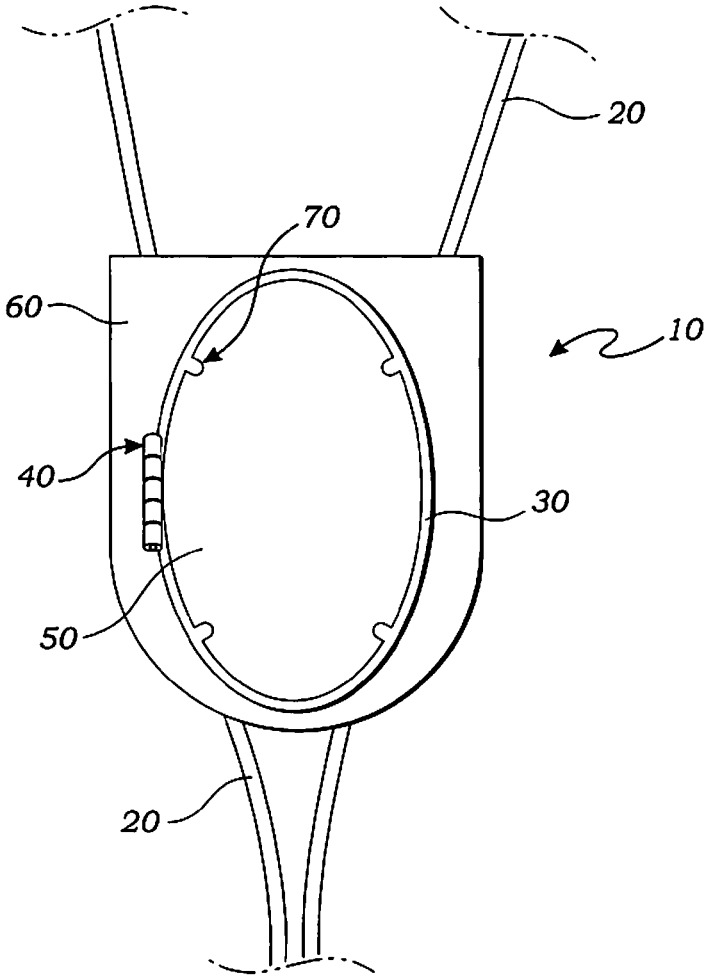
FIG. 1 is an anterior plan view of the presently described apparatus.
Figure 2:
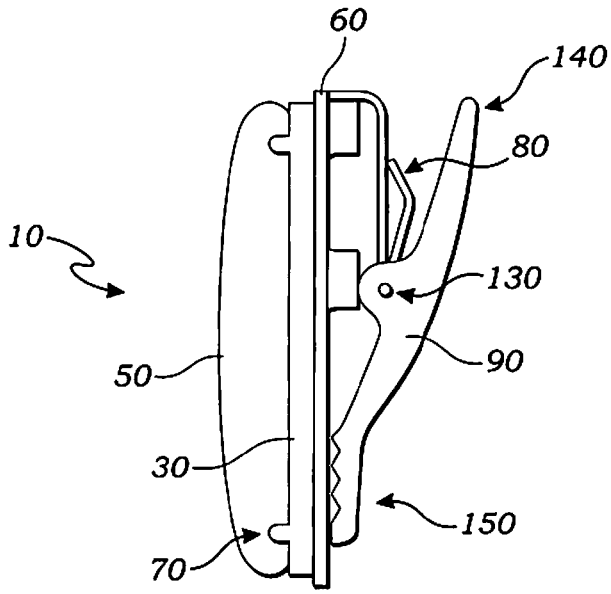
FIG. 2 is a side plan view thereof.
Figure 4:
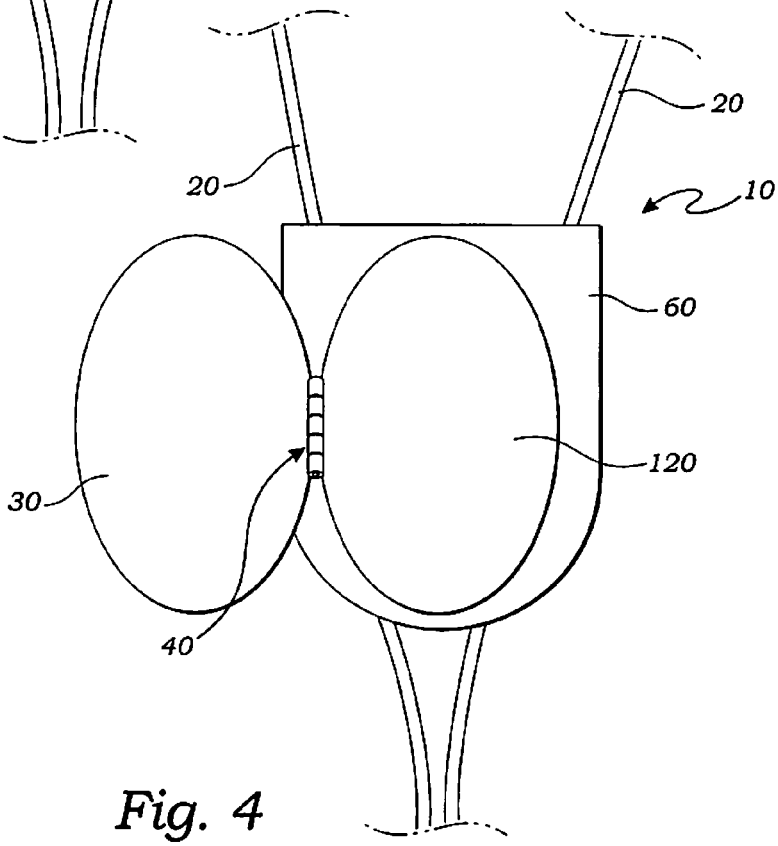
FIG. 4 is an anterior plan view of the presently described apparatus with the hinged decorative face fully rotated.
Figure 5:
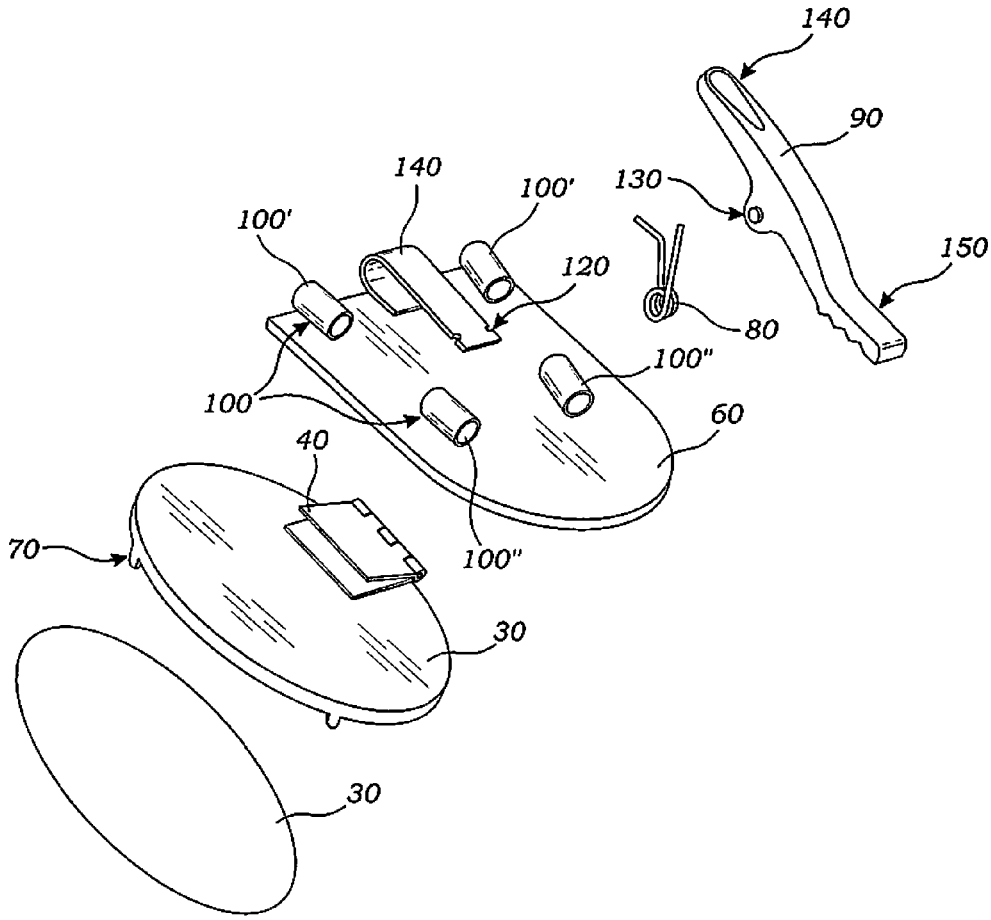
FIG. 5 is an exploded perspective view thereof.

Described now in detail is a bolo style tie clasp or slide apparatus 10 shown in FIG. 1, comprising a base piece 60 having an anterior and a posterior surface. Attached to the posterior surface of the base piece 60 is a coupling apparatus 90 and a mechanism 100 to frictionally engage a length of flexible cord, braid, or lariat (hereafter "flexible cord") 20 at two points proximate both ends to form a loop that, when in use, encircles the wearer's neck forming a necktie style accessory. Attached to the anterior surface of the base piece 60 is a hinge 40 having two surfaces on opposing sides of a joint. The hinge 40 surface adjacent to the base piece 60 is affixed to a setting piece 30 which, in turn, holds and displays an ornamental face 50. The ornamental face 50 can be a precious or semiprecious stone cut to an appropriate size as shown in FIG. 5 or a design or other aesthetically pleasing item. The setting piece has physical characteristics that hold the ornamental face such as a bezel setting or as shown in the exemplary embodiment in FIG. 2 prong settings 70. The hinge 40 allows the setting piece 30 and affixed ornamental face 50 to rotate between a closed configuration depicted in FIG. 1 and an open configuration depicted in FIG. 4. The anterior surface of the base piece 60, immediately adjacent to the setting piece 30 when in the closed configuration, is recessed creating a cavity 120 for the storage of small items such as a pill or photograph.

Figure 3:
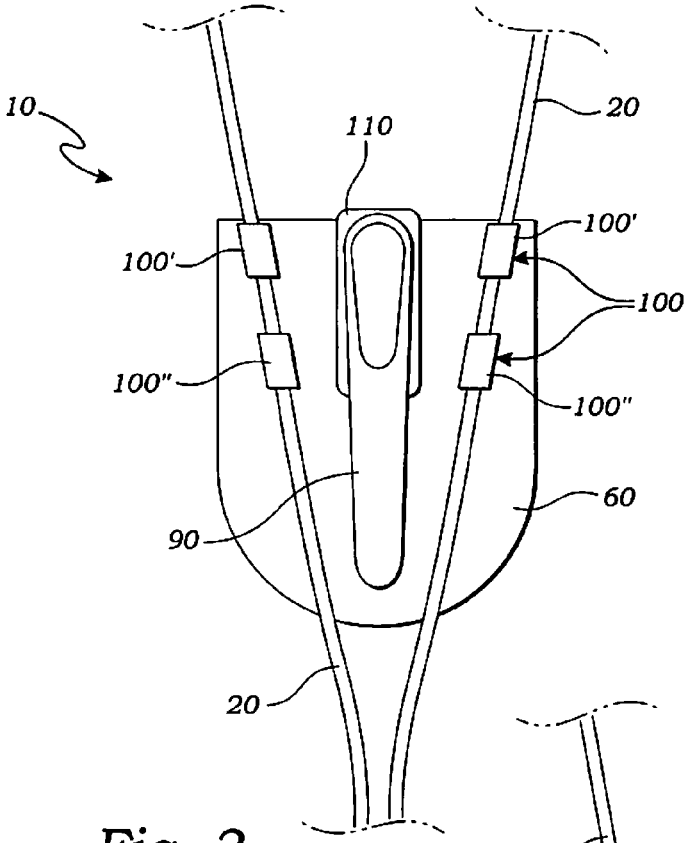
FIG. 3 is a posterior plan view thereof.

In the exemplary embodiment, the frictional engagement mechanism 100 consists of two pairs of loops, an upper pair 100' and a lower pair 100". Each end of the length of flexible cord 20 passes through an upper loop 100' and a lower loop 100" consecutively as depicted in FIG. 3. The loops 100', 100" are sized to encircle the flexible cord 20 with a slight compression fit thereby requiring a predetermined amount of force to draw the flexible cord through the dual loop configuration. The requisite force is greater than that of the gravitational pull on the clasp or slide 10 but is small enough so that the wearer can intentionally draw the flexible cord 20 through the dual loop configuration with ease. It will be appreciated by those skilled in the art that there are a number of mechanisms that are capable of frictionally engaging a flexible cord 20 that are possible without departing from the spirit and scope of the invention.

The coupling apparatus 90 is supported by a mounting structure 110. In the exemplary embodiment, the mounting structure 110 consists of a curved member with two ends, a proxal end attached to the posterior surface of the base piece 60 and a distal end engaged with the coupling structure 90 through a pair of axially oriented pin shaped features 120. The coupling apparatus consists of a singular alligator clip style claw 90 having a gripping end 150 and a lever end 140. Additionally, the claw 90 has pair axially oriented holes 130 located to accept and pivot about the pin shaped features 120 of the mounting structure 110 creating a fulcrum point. The mount structure 110 situates the claw 90 such that the gripping end 150 can hold small objects, e.g. a pair of reading glasses or the corner of a napkin, by compressing them between the gripping end 150 of the claw 90 and the posterior surface of the base piece 60. The compression force is provided a spring 80 coiled about the axis of the fulcrum point providing torque oriented to induce a clockwise rotation of the claw 90 when viewed from the perspective of FIG. 2. The wearer may overcome the spring's 80 force by exerting a greater force on the lever end 140 of the claw 90 with his or her finger or thumb.

The ennoblements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What I claim is:

1. A bolo style clasp or slide apparatus, the apparatus comprising:

a base piece having an anterior surface and a posterior surface;

an engagement mechanism affixed to said base piece capable of frictional communication with both ends of a length of flexible cord;

a coupling affixed to the posterior surface of said base piece, said coupling device capable of reversibly mating with a variety of small objects, wherein said coupling device is a torsion spring; and a singular alligator clip style claw having a gripping end and a lever end, said gripping end capable of exerting a compression force on small objects holding them between said gripping end and the posterior surface of said base piece.

2. A bolo style clasp or slide apparatus, the apparatus comprising:

a base piece having an anterior surface and a posterior surface;

an engagement mechanism affixed to said base piece capable of frictional communication with both ends of a length of flexible cord;

a coupling affixed to the posterior surface of said base piece, said coupling device capable of reversibly mating with a variety of small objects, wherein said coupling device is a torsion spring; and a pair of alligator clip style claws having gripping ends and lever ends rotatably attached at their midpoints, said gripping ends capable of exerting opposing compression forces on small objects holding them between said gripping ends.

3. A bolo style clasp or slide apparatus, the apparatus comprising:

a base piece having an anterior and posterior surface;

an engagement mechanism affixed to said base piece capable of frictional communication with both ends of a length of flexible cord;

a coupling device affixed to the posterior surface of said base piece, said coupling device capable of reversibly mating with a variety of small objects; and a setting piece rotatably attached to said base piece allowing setting piece to assume a closed attitude whereby said setting piece and said base piece lie in parallel planes or to assume an open attitude whereby said setting piece and said base piece lie in a common plane.

4. The apparatus of claim 3, wherein said coupling device is a torsion spring; and a singular alligator clip claw having a gripping end and a lever end, wherein said gripping end capable of exerting a compression force on small objects holding them between said gripping end and the posterior surface of said base piece.

5. The apparatus in claim 3, wherein said coupling device is a torsion spring; and a pair of alligator clip style claws having griping ends and lever ends rotatably attached at their midpoints, said gripping ends capable of exerting opposing compression forces on small objects and holding them between said gripping ends.

* * * * *